US007145418B2

(12) United States Patent
Akale et al.

(10) Patent No.: US 7,145,418 B2
(45) Date of Patent: Dec. 5, 2006

(54) BANDPASS FILTER

(75) Inventors: Tamrat Akale, Azusa, CA (US); Allen Wang, Buena Park, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/012,629

(22) Filed: Dec. 15, 2004

(65) Prior Publication Data

US 2006/0125578 A1 Jun. 15, 2006

(51) Int. Cl.
*H01P 1/203* (2006.01)

(52) U.S. Cl. ..... 333/204

(58) Field of Classification Search ..... 333/204, 333/205, 219

See application file for complete search history.

(56) References Cited

U.S. PATENT DOCUMENTS 3,104,362 A * 9/1963 Matthaei ..... 333/204
4,020,428 A 4/1977 Friend et al.
4,210,881 A 7/1980 Rubin
4,455,540 A * 6/1984 Henriot et al. ..... 333/202
4,560,964 A 12/1985 Meier
4,701,727 A 10/1987 Wong
5,015,976 A 5/1991 Saka
5,404,119 A 4/1995 Kim
5,442,330 A * 8/1995 Fuller et al. ..... 333/204
5,939,958 A 8/1999 Grounds, III et al.
6,130,189 A * 10/2000 Matthaei ..... 505/210
6,252,476 B1 * 6/2001 Maloratsky ..... 333/204
6,288,345 B1 9/2001 Akale et al.
6,414,570 B1 7/2002 Dalconzo et al.
6,750,741 B1 * 6/2004 Mordkovich ..... 333/204
6,762,660 B1 7/2004 Allison
2003/0222736 A1 12/2003 Allison

OTHER PUBLICATIONS

Aleksandrovsky et al., "Selective Properties of Microstrip Filters Based on Hairpin Resonators with Stub Elements", Microwave Electronics: Measurements, Indentification, Application Conference, 2001, MEMIA 2001, Sep. 18-20, 2001, pp. 82-85.*
Kuo et al., "Parallel Coupled Microstrip Filters with Suppression of Harmonic Response," IEEE Microwave and Wireless Components Letters, vol. 12, No. 10, Oct. 2002, pp. 383-385.*
Moazzam M R et al: Improved Performance Parallel-Coupled "Microstrip Filters" Microwave Journal, Horizon House.
Hong I et al: "A novel wiggly-line hairpin filter with 2nd spurious passband suppresion" Microwave Conference, 2004. 34th European Amsterdam, The Netherlands Oct. 13, 2003.
Microwaves & RF Nov. 1999—Techniques Yield Tiny Hairpin-Line Resonator Filters, pp. 1-11, by Rodrigo Neves Martins, http://www.mwrf.com/Globals/PlanetEE/dsp_article.cfm?ArticleID=9356&Extension=html.
Integrated millimeter-wave band-pass filters in LTCC modules, M. Lahti et al., VTT Electronics, Sep. 2003.
Microwave Filters, Impedance-Matching Networks, and Coupling Structures, Copyright 1980, Artech House, Inc., pp. 472-477.

(Continued)

*Primary Examiner*—Seungsook Ham
(74) *Attorney, Agent, or Firm*—Leonard A. Alkov; Karl A. Vick

(57) ABSTRACT

An edge-coupled filter includes a phase velocity compensation transmission line section comprising a series of spaced alternating T-shaped conductor portions.

35 Claims, 3 Drawing Sheets

OTHER PUBLICATIONS

High Frequency Design, Design of a Microstrip Bandpass Filter Using Advanced Numerical Models, by Michael A. Imparato, Ryan C. Grouix and Raphael Matarazzo, Aeronix, Inc., Mar. 2004, High Frequency Electronics.

* cited by examiner

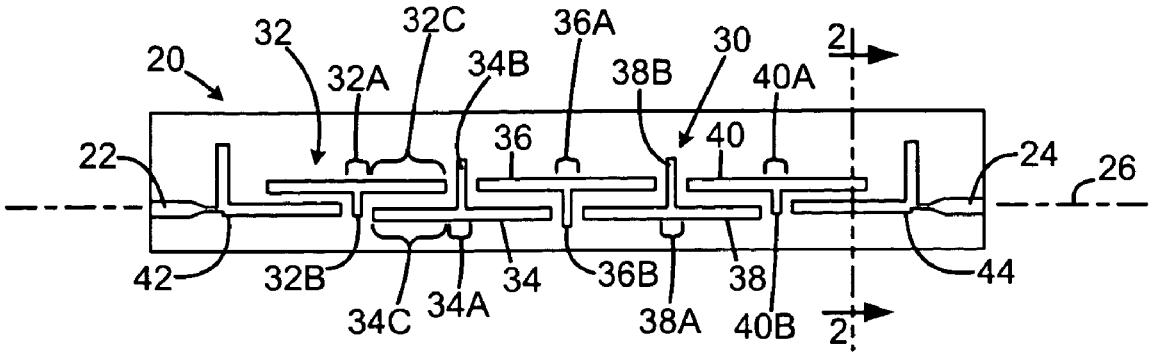
FIG. 1
FIG. 2
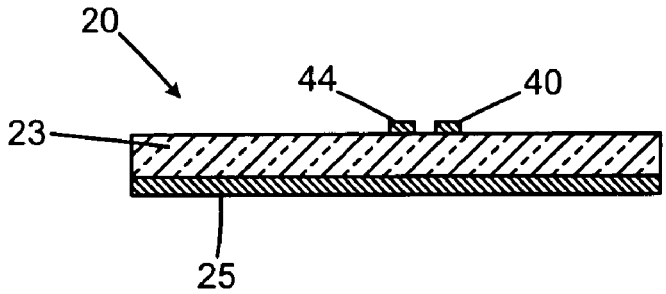
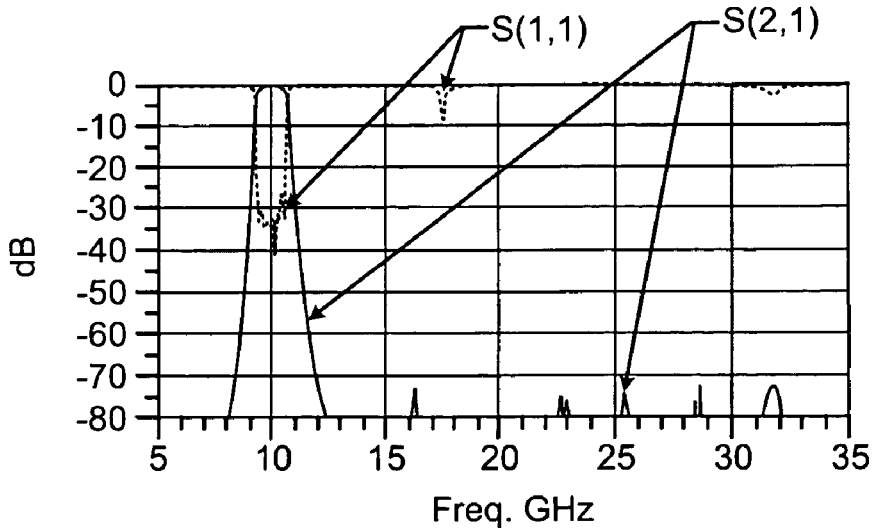
FIG. 3

BANDPASS FILTER

BACKGROUND

This invention was made with United States Government support under Contract No. F33657-99-D-0028 awarded by the Department of the Air Force. The United States Government has certain rights in this invention.

Most microwave filters built using microstrip transmission lines have a tendency of not suppressing $2^{nd}$, $3^{rd}$ and $4^{th}$ harmonic signals. Traditionally, the way to solve this problem is to add a lowpass filter at the two ends of a bandpass filter. Physically, this makes the filter structure bigger. Electrically, using lowpass filters increase signal loss, and the suppression of the harmonics for the most part is not as good as desired.

SUMMARY OF THE DISCLOSURE

An edge-coupled filter includes a phase velocity compensation transmission line section comprising a series of alternating T-shaped conductor portions.

BRIEF DESCRIPTION OF THE DRAWINGS

Features and advantages of the disclosure will readily be appreciated by persons skilled in the art from the following detailed description when read in conjunction with the drawing wherein:

FIG. 1 is a layout of an exemplary embodiment of a bandpass filter.

FIG. 2 is a cross-sectional diagrammatic view of the filter of FIG. 1, taken along line 2—2 of FIG. 1.

FIG. 3 is a graph of attenuation as a function of frequency for an exemplary filter implementation, where the response shows attenuation of the $2^{nd}$ and $3^{rd}$ harmonics.

DETAILED DESCRIPTION

Figure 4A:
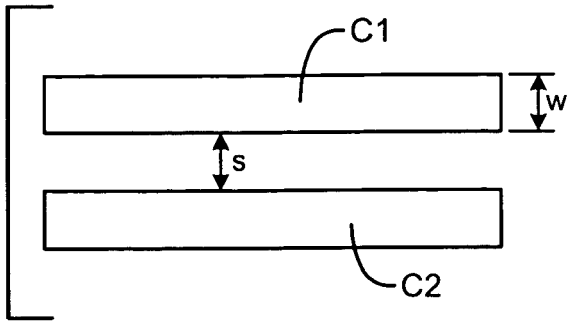
FIG. 4A is a top view of an enlarged portion of a filter layout, showing overlapped, edge-coupled conductor strips.

In the following detailed description and in the several figures of the drawing, like elements are identified with like reference numerals.

In an edge coupled filter fabricated in a planar transmission line medium, such as microstrip or stripline, energy is propagated through the filter through edge-coupled resonator elements or conductor strips. Harmonics in the filter response appear due to the mismatch in phase velocities of the even and odd modes. In microstrip coupled lines, the odd mode travels faster than the even mode. Also, the odd mode tends to travel along the outer edges of the microstrip coupled lines or conductor strips, while the even mode tends to travel near the center. In an exemplary embodiment, to suppress the harmonics of the filter, a means for equalizing the even and odd mode electrical lengths is provided.

In an exemplary embodiment illustrated in FIGS. 1 and 2, a microstrip filter 20 comprises spatially separated input/output (I/O) ports 22 and 24, which are connected by a phase velocity compensation transmission line section 30. The transmission line section 30 comprises edge-coupled resonator elements 32–40 in this exemplary embodiment. The ports 22, 24 are positioned along a filter axis 26 in this embodiment. The transmission line section 30 comprises a series of alternating conductor sections or lines 32–40, arranged in a staggered offset manner relative to the filter axis 26. The conductor sections are edge-coupled at an RF operating frequency band. The spatial separation of the conductor sections provides DC isolation. The lines 32–40 include coupled line portions which are adjacent a corresponding coupled line portion of an adjacent conductor line. For example, line 32 includes a line segment 32C which overlaps a line segment 34C of line 34. These overlapping line segments are approximately ¼ wavelength in length in an exemplary embodiment, at an operating frequency.

Each conductor section includes a respective T-shaped portion 32A–40A. The T-shaped portions have a parallel leg portion oriented in parallel to the filter axis, and a transverse stub oriented perpendicularly to and bisecting the parallel leg portion in this exemplary embodiment. For example, T-shaped portion 32A has a parallel leg portion (comprising a portion of the conductor section 32) and a transverse stub 32B. The directions of the transverse stubs 32B–40B alternate, as do the stub lengths. The filter response is symmetric about its center frequency (as shown in FIG. 3); depending on the length of the ¼ wave length coupled line, the transverse stub lengths may be optimized, which may result in different stub lengths. Because the odd mode tends to travel along the outer edges of the coupled lines or conductor strips, while the even mode tends to travel near the center, the T-shaped sections add transmission line length which is traveled by the odd mode, but not the even mode. As a result, the odd and even mode components propagating along the transmission line 30 arrive at the output port in phase.

The exemplary filter embodiment of FIGS. 1 and 2 may be constructed in microstrip. The filter comprises a substantially planar dielectric substrate 23, e.g. a substrate such as alumina or duroid having a substrate height h. A conductive ground plane layer 25 is formed on one surface of the dielectric substrate, here the bottom surface of the substrate 23. A conductive microstrip trace pattern is formed on the opposite substrate surface, in this example the top surface. The trace pattern forms the conductor sections 32–40 and the I/O ports 22, 24. In an exemplary embodiment, the trace pattern may be fabricated using photo lithographic techniques.

The phase velocity mismatches of the even and odd modes may be compensated by extending the odd mode traveling path. In an exemplary filter structure, the alternating T-shaped portions of the filter provide the compensation. In a microstrip coupled line, the odd mode is faster and tends to travel on the edges of the line, while the even mode is slower and travels along the center of the coupled lines. The exemplary filter architecture illustrated in FIG. 1 compensates for the mismatch of phase velocities of the even and odd modes in the filter structure by periodically introducing stubs, and by adjusting the electrical length of the quarter wave coupled line sections in the filter. In an exemplary embodiment, most of the phase compensation is provided by the T-shaped portions. Some phase compensation may be provided by varying the lengths of the coupled lines away from the nominal ¼ wavelength, e.g. by optimization.

Figure 4B:
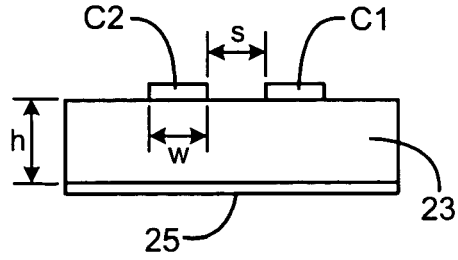
FIG. 4B is a diagrammatic end view of the bandpass filter of FIG. 3A.
Figure 4C:
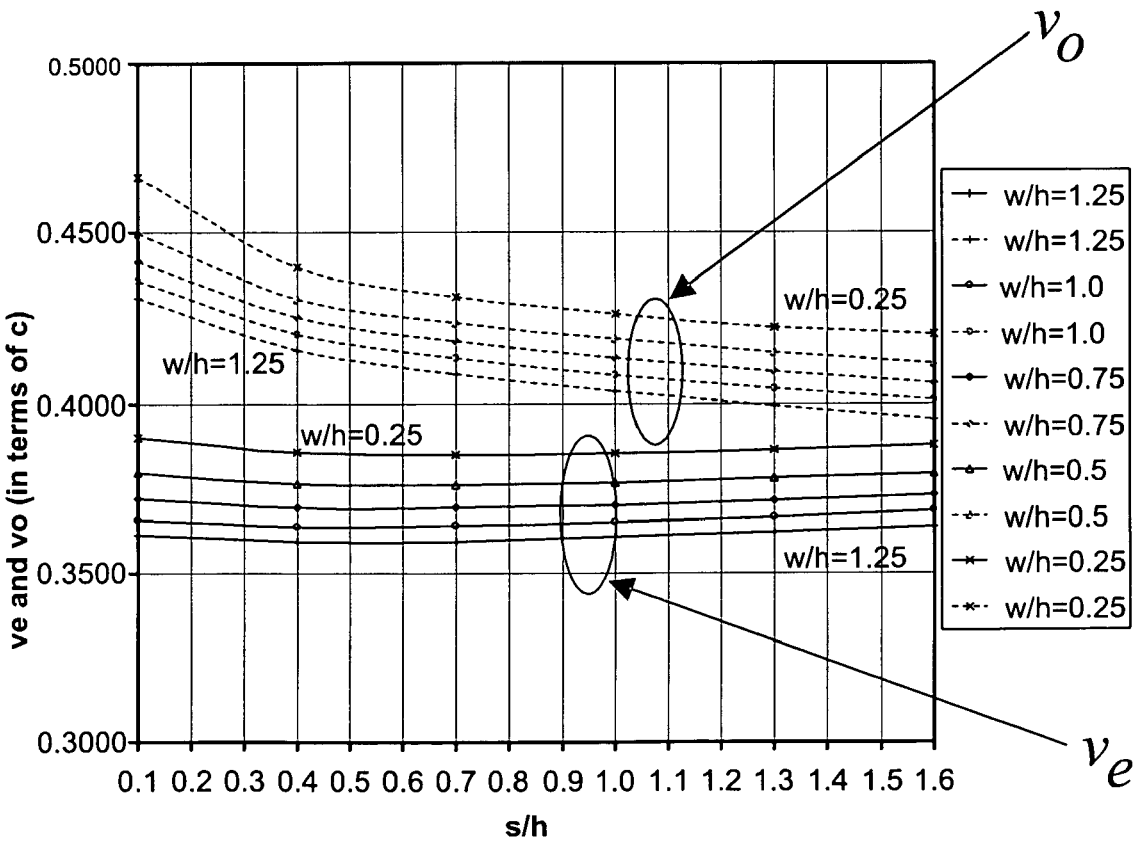
FIG. 4C is a graph depicting velocities of even and odd modes of propagation as a function of filter parameters.

FIGS. 4A–4C depict how variation in design parameters for a microstrip transmission line embodiment affect the phase velocities of the even and odd modes propagating in an edge coupled filter. FIG. 4A is a diagrammatic illustration of edge-coupled conductor strips C1 and C2 formed as microstrip conductors on a surface of a dielectric substrate 23. The conductor strips C1 and C2 are arranged in parallel, and are spaced apart by a distance s. As depicted in the end view, FIG. 4B, the substrate 23 has a height h. FIG. 4C is a graph showing calculated phase velocities for the even mode (ve) and odd mode (vo) as a function of the ration s/h, and for different ratios w/h.

In an exemplary simulation embodiment, the filter 20 attenuates the $2^{nd}$ and $3^{rd}$ harmonics as shown in FIG. 3 with very good out-of-band rejection. FIG. 3 is a graph of attenuation as a function of frequency for an exemplary filter implementation, over a passband centered at 10 GHz, with a nominal bandwidth which is about 2.5 GHz. FIG. 3 illustrates an exemplary simulation plot of the return loss (S(1,1)) and insertion loss (S(2,1)) as a function of frequency. The exemplary simulation embodiment whose performance is depicted in FIG. 3 was done using Agilent=s ADS linear simulator tool. This exemplary embodiment of a microstrip filter also exhibits very low loss filter with very high out-of-band rejection characteristics. This exemplary filter embodiment exhibits a good linear phase for over 80% of the filter bandwidth. Harmonics in the insertion loss characteristic have been suppressed.

An embodiment of the filter is very compact, resulting in significant reduction of size and weight of most microwave integrated circuits which utilize multiple filters.

This filter architecture can be implemented in a transmission line type other than microstrip, e.g. in stripline or coplanar waveguide.

Figure 5:
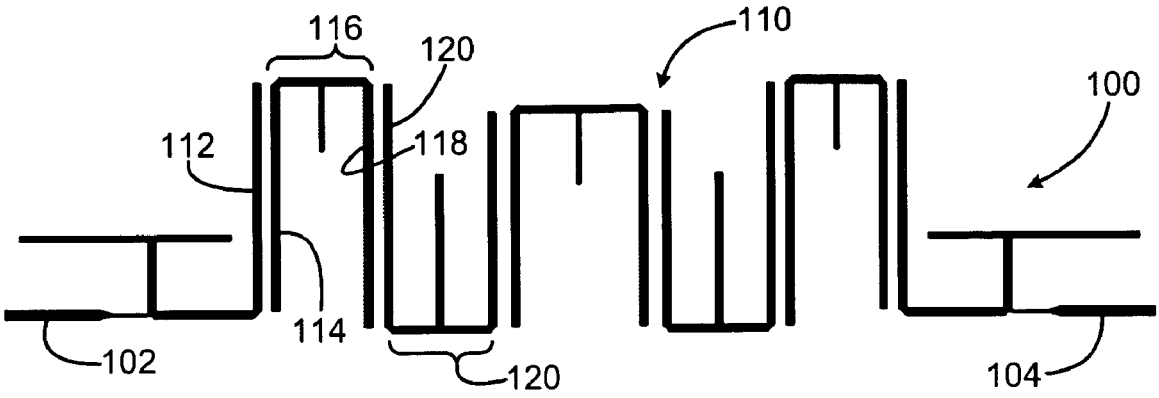
FIG. 5 is a layout of an alternate embodiment of a bandpass filter.

Another exemplary embodiment is illustrated in FIG. 5, which depicts a layout of a hairpin filter 100. The hairpin configuration comprises I/O ports 102, 104, and a phase velocity compensation transmission line section 110. The transmission line section 110 is arranged in a serpentine or series of U-shaped bends, each comprising edge-coupled resonator sections and a T-shaped portion disposed in the U-bend. For example, conductor sections 112, 114 are around ¼ wavelength in electrical length at an operating frequency, and are disposed in parallel with a spacing between them. Similarly conductor sections 118, 120 are edge-coupled. T-shaped portion 116 connects ends of conductor sections 114, 118, and provides phase velocity phase compensation. The lengths of the ¼ wavelength sections may also adjusted to provide phase velocity compensation. The filter 100 can be constructed in microstrip or stripline, for example. An exemplary passband is 200 MHz centered at 1.85 GHz.

Although the foregoing has been a description and illustration of specific embodiments of the invention, various modifications and changes thereto can be made by persons skilled in the art without departing from the scope and spirit of the invention as defined by the following claims.

What is claimed is:

1. An edge-coupled microstrip filter, comprising:

a dielectric substrate having opposed first and second surfaces;

a conductive ground plane disposed on the first surface;

a microstrip conductive trace pattern disposed on the second surface, said trace pattern defining a phase velocity compensation transmission line section comprising a series of spaced alternating T-shaped conductor portions, said T-shaped portions comprising a parallel leg and an open-circuited transverse stub, said stub providing a transmission line length traveled by an odd mode of energy propagation and not by an even mode of energy propagation, and wherein the phase velocity compensation transmission line section provides phase compensation for odd mode energy propagation at a different rate than even made energy propagation to suppress at least second and third harmonics of a filter response.

2. The filter of claim 1, wherein said parallel leg of said T-shaped conductor portions is oriented in parallel to a filter axis, and said transverse stub is oriented transversely to the parallel leg.

3. The filter of claim 2, wherein the transverse stub of said T-shaped portion bisects said parallel leg.

4. The filter of claim 1, wherein said phase velocity compensation transmission line section provides compensation for an odd mode propagation velocity which is greater than an even mode propagation velocity.

5. The filter of claim 1, wherein harmonics of a response of the filter are suppressed by said phase velocity compensation transmission line section.

6. The filter of claim 1, wherein said filter is free of low pass filters.

7. An RF bandpass filter circuit, comprising:

a fast input/output (I/O) port;

a second I/O port;

a plurality of parallel-coupled resonators formed in a planar transmission line, the resonators arranged for signal coupling between alternate resonators in the form of transmission line gaps;

the planar transmission line comprising a plurality of T-shaped portions for phase velocity compensation, said T-shaped portions comprising a parallel leg and an open-circuited transverse stub, said stub providing a transmission line length traveled by an odd mode of energy propagation and not by an even mode of energy propagation, and wherein said plurality of T-shaped portions provides phase compensation for a first mode of energy propagation at a different rate than a second mode of energy propagation to suppress at least second and third harmonics of a filter response.

8. The filter of claim 7, wherein parallel leg of said T-shaped conductor portions is oriented in parallel to a filter axis, and said transverse stub is oriented transversely to the parallel leg.

9. The filter of claim 8, wherein the transverse stub of said T-shaped portion bisects said parallel leg.

10. The filter of claim 7, wherein the planar transmission line is a microstrip transmission line.

11. The filter of claim 7, wherein the planar transmission line is a stripline line.

12. The filter of claim 7, wherein the planar transmission line is a coplanar waveguide.

13. The filter of claim 7, wherein the planar transmission line comprises:

a dielectric substrate having first and second opposed planar surfaces;

a ground plane formed on the first dielectric surface;

said resonators formed on the second dielectric surface, the resonators arranged in a staggered arrangement about a linear filter axis with gaps between ends of alternate resonators to provide edge coupling between alternate resonators.

14. The filter of claim 7, wherein the transmission line is arranged in a hairpin configuration.

15. The filter of claim 14, wherein the T-shaped portions are arranged in U-bends of the hairpin configuration.

16. The filter of claim 7, wherein said phase velocity said plurality of T-shaped portions provides compensation for an odd mode propagation velocity which is greater than an even mode propagation velocity.

17. The filter of claim 16, wherein harmonics of a response of the filter are suppressed by said T-shaped portions.

18. The filter of claim 7, wherein said filter is free of low pass filters at said first and second I/O ports.

19. An RF bandpass filter circuit, comprising:

a first input/output (I/O) port;

a second I/O port;

a phase velocity compensation transmission line section coupled between said first I/O port and the second I/O port, said transmission line section comprising a plurality of parallel-coupled conductor portions formed in a planar transmission line medium, the conductors arranged for signal coupling between alternate conductors in the form of transmission line gaps;

the phase velocity compensation transmission line section comprising a plurality of T-shaped portions for phase velocity compensation, said T-shaped portions comprising a parallel leg and an open-circuited transverse stub, said stub providing a transmission line length traveled by an odd mode of energy propagation and not by an even mode of energy propagation, and wherein the phase velocity compensation transmission line section provides phase compensation for odd mode energy propagation at a different rate than even mode energy propagation to suppress at least second and third harmonics of a filter response.

20. The filter of claim 19, wherein parallel leg of said T-shaped conductor portions is oriented in parallel to a filter axis, and said transverse stub is oriented transversely to the parallel leg.

21. The filter of claim 20, wherein the transverse stub of said T-shaped portion bisects said parallel leg.

22. The filter of claim 19, wherein the phase velocity compensation transmission line section is a microstrip transmission line section.

23. The filter of claim 19, wherein the phase velocity compensation transmission line section is a stripline section.

24. The filter of claim 19, wherein the phase velocity compensation transmission line section comprises:

a dielectric substrate having first and second opposed planar surfaces;

a ground plane formed on the first dielectric surface;

said parallel-coupled conductors formed on the second dielectric surface in a staggered arrangement about a linear filter axis with gaps between ends of alternate conductors to provide edge coupling.

25. The filter of claim 19, wherein said phase velocity compensation line section provides compensation for an odd mode propagation velocity which is greater than an even mode propagation velocity.

26. The filter of claim 25, wherein harmonics of a response of the filter are suppressed by said phase velocity compensation transmission line section.

27. The filter of claim 19, wherein said filter is free of low pass filters at said first and second I/O ports.

28. A harmonic-free microstrip filter, comprising:

a dielectric substrate having opposed first and second surfaces;

a conductive ground plane disposed on the first surface;

a microstrip conductive trace pattern disposed on the second surface, said trace pattern defining a phase velocity compensation transmission line section comprising a series of spaced alternating T-shaped conductor portions, said T- shaped portions comprising a parallel leg and an open-circuited transverse stub, said phase velocity compensation transmission line section providing compensation for an odd mode propagation velocity which is greater than an even mode propagation velocity to suppress at least second and third harmonics of a filter response.

29. An edge-coupled RF bandpass filter circuit, comprising:

a phase velocity compensation transmission line section, said transmission line section comprising a plurality of parallel-coupled conductor portions, the conductors arranged for signal coupling between alternate conductors in the form of transmission line gaps;

the phase velocity compensation transmission line section comprising a plurality of phase velocity compensation conductor portions, said conductor portions comprising a parallel leg and an open-circuited transverse stub, providing added electrical length for only odd mode propagation modes to compensate for an odd mode propagation velocity which is greater than an even mode propagation velocity to suppress at least second and third harmonics of a filter response.

30. The filter of claim 29, wherein the phase velocity compensation transmission line section is a microstrip transmission line section.

31. The filter of claim 29, wherein the phase velocity compensation transmission line section is a stripline section.

32. The filter of claim 29, wherein the transmission line section is arranged in a hairpin configuration.

33. The filter of claim 29, wherein the phase velocity compensation conductor portions are arranged in U-bends of the hairpin configuration.

34. The filter of claim 29, wherein the plurality of parallel-coupled conductor portions are arranged in a staggered relationship relative to a linear filter axis.

35. The filter of claim 29 wherein the phase velocity compensation conductor portions have a T-shaped configuration.

* * * * *